US005083948A

United States Patent [19]

Grobson

[11] Patent Number: 5,083,948

[45] Date of Patent: Jan. 28, 1992

[54] PERSONAL WATERCRAFT USING STRING TRIMMER OR SIMILAR POWER SOURCE

[76] Inventor: Lonnie B. Grobson, 30627 Possum Trail, Magnolia, Tex. 77355

[21] Appl. No.: 570,529

[22] Filed: Aug. 21, 1990

[51] Int. Cl.[5] ..... B63H 21/26

[52] U.S. Cl. ..... 440/49; 440/6; 440/83; 440/113; 440/900; 30/122

[58] Field of Search ..... 440/71, 72, 49, 6, 53, 440/113, 900, 83; 30/276, 122, 500; 56/12; 172/111, 120, 247

[56] References Cited

U.S. PATENT DOCUMENTS

| | | | |
|---|---|---|---|
| 1,875,451 | 9/1932 | Harris | 440/900 |
| 2,513,050 | 6/1950 | Pugh | 440/53 |
| 4,188,719 | 2/1980 | Hoff | 30/122 |
| 4,604,067 | 8/1986 | Roberts | 440/49 |
| 4,680,017 | 7/1987 | Eller | 440/72 |
| 4,726,183 | 2/1988 | Gongwer | 440/72 |
| 4,752,256 | 6/1988 | Dorion | 440/49 |
| 4,926,781 | 5/1990 | Bauer | 440/72 |

*Primary Examiner*—Joseph F. Peters, Jr.
*Assistant Examiner*—Clifford T. Bartz
*Attorney, Agent, or Firm*—Richard C. Litman

[57] ABSTRACT

A relatively small and light weight personal watercraft includes a driveshaft tunnel which permits the driveshaft housing of a string trimmer apparatus to be installed therein. The string trimmer apparatus is modified by removing the string trimmer or other head which may be attached, installing a propeller(s) or impeller(s), removing any handles from the string trimmer, temporarily removing the power head so that driveshaft housing may be installed within the driveshaft tunnel of the watercraft, installing a fairing (if desired) and/or handlebars, and reattaching the throttle control to the handlebars. The modified string timmer may be used as both a power system for the watercraft and also provides directional control by turning the attached handlebars or fairing in order to rotate the power system about an axis concentric with the driveshaft and thereby change the direction of the thrust line of the propeller(s) or impeller(s). The watercraft may possess additional features, such as hand holds and a wheel for ease of maneuvering on shore, and an exhaust system which routes all engine exhaust downward through the hull of the watercraft.

14 Claims, 3 Drawing Sheets

PERSONAL WATERCRAFT USING STRING TRIMMER OR SIMILAR POWER SOURCE

FIELD OF THE INVENTION

This invention relates generally to small watercraft powered by internal combustion engines, and more specifically to such a watercraft especially designed to use a slightly modified engine and apparatus of the string trimmer type or the like as a power source.

BACKGROUND OF THE INVENTION

Various recreational activities have gained in popularity as additional leisure time has become available to people. Among the more popular activities are those involving aquatic sports and recreation. With the advent of the internal combustion engine, the relatively small powered boat or watercraft became feasible. However, it has not been until relatively recently that advances in the internal combustion engine have resulted in such engines sufficiently small and light to efficiently propel a small watercraft designed to carry only one or two persons and affording little or no protection from the elements.

Many people enjoy using such watercraft, but even with the development of relatively small engines, such craft typically weigh several hundred pounds and are powered by engines developing on the order of fifty horsepower or perhaps more. Such watercraft are high performance vehicles, and require a trailer and/or two or more persons to transfer the craft from shore to water and back. Moreover, such craft are relatively costly and require a relatively large amount of fuel. In addition, as noted above this type of craft is of relatively high performance and there is little opportunity for training novice operators of such craft with a smaller, lighter and lower powered craft.

What is needed is a small, lightweight watercraft intended for the use of a single adult operator, or perhaps two younger persons, and powered by a smaller and lighter engine than has been heretofore installed in such craft. The engine should preferably be equipped with a suitable drive train and other ancillary equipment, and should be capable of being easily modified and installed in the watercraft. The engine and power train should be readily available and relatively inexpensive when compared to existing power systems currently used in such watercraft. The watercraft itself should be designed so as to advantageously use such a readily available engine and power train and therefore be of relatively small size and light weight.

DESCRIPTION OF THE RELATED ART

Relatively little art is known to have been developed in the use or adaptation of very small internal combustion powerplants, such as are used in string trimmers, chain saws, and the like, in combination with very small watercraft. Roberts U.S. Pat. No. 4,604,067 is perhaps most closely related to the present invention, disclosing a method and apparatus for converting a trimmer into an outboard trolling motor. Several modifications are necessary in order to make the conversion, and several special components are required. Moreover, the patent of Roberts makes no provision for a specially developed watercraft in order to take advantage of the small size of the powerplant, but provides only for the attachment of the modified string trimmer device to the transom of an existing boat. In addition, as with most outboard motors no provision is made for a shroud or guard around the propeller in order to prevent contact with the operating propeller.

Dorios U.S. Pat. No. 4,752,256 discloses an adapter for the conversion of a conventional internal combustion engine powered trimmer to a boat propulsion device. Again, no provision is made for a watercraft to take advantage of the relatively small output of the device as with the present invention.

Tuggle U.S. Pat. No. 4,286,675 discloses a relatively small and lightweight power head for use with various cutting and trimming tools. However, the Tuggle patent does not anticipate the use of this power head with any propulsion component, and moreover does not disclose any form of boat or watercraft specifically designed to make optimum use of such a small powerplant as does the present invention.

None of the above noted patents, either singly or in combination, are seen to disclose the specific arrangement of concepts disclosed by the present invention.

SUMMARY OF THE INVENTION

By the present invention, an improved powered watercraft for individual use is disclosed.

Accordingly, one of the objects of the present invention is to provide for an improved watercraft especially designed to use a slightly modified string trimmer apparatus or the like as a power system.

Another of the objects of the present invention is to provide a watercraft and attachments with which a string trimmer or like device may be quickly and easily modified for use as a power system for such a watercraft.

Yet another of the objects of the present invention is to provide a watercraft which is capable of relatively good performance using a small, lightweight power system.

Still another of the objects of the present invention is to provide a watercraft in which the entire power system excepting the propeller and shaft end may be mounted inboard, but which power system and associated drive train may be swiveled in its entirety in order to provide steering for the watercraft.

A further object of the present invention is to provide a watercraft which is capable of carrying either a single adult operator or two younger and smaller persons.

An additional object of the present invention is to provide a watercraft which may be easily transported from shore to water, or water to shore, by a single person.

Another object of the present invention is to provide a watercraft which, as a part of its integral construction, provides for the cooling of the exhaust of the power system.

With these and other objects in view which will more readily appear as the nature of the invention is better understood, the invention consists in the novel combination and arrangement of parts hereinafter more fully described, illustrated and claimed with reference being made to the attached drawings.

BRIEF DESCRIPTION OF THE DRAWINGS

Similar reference characters designate corresponding parts throughout the several figures of the drawings.

DESCRIPTION OF THE PREFERRED EMBODIMENT

Figure 1:
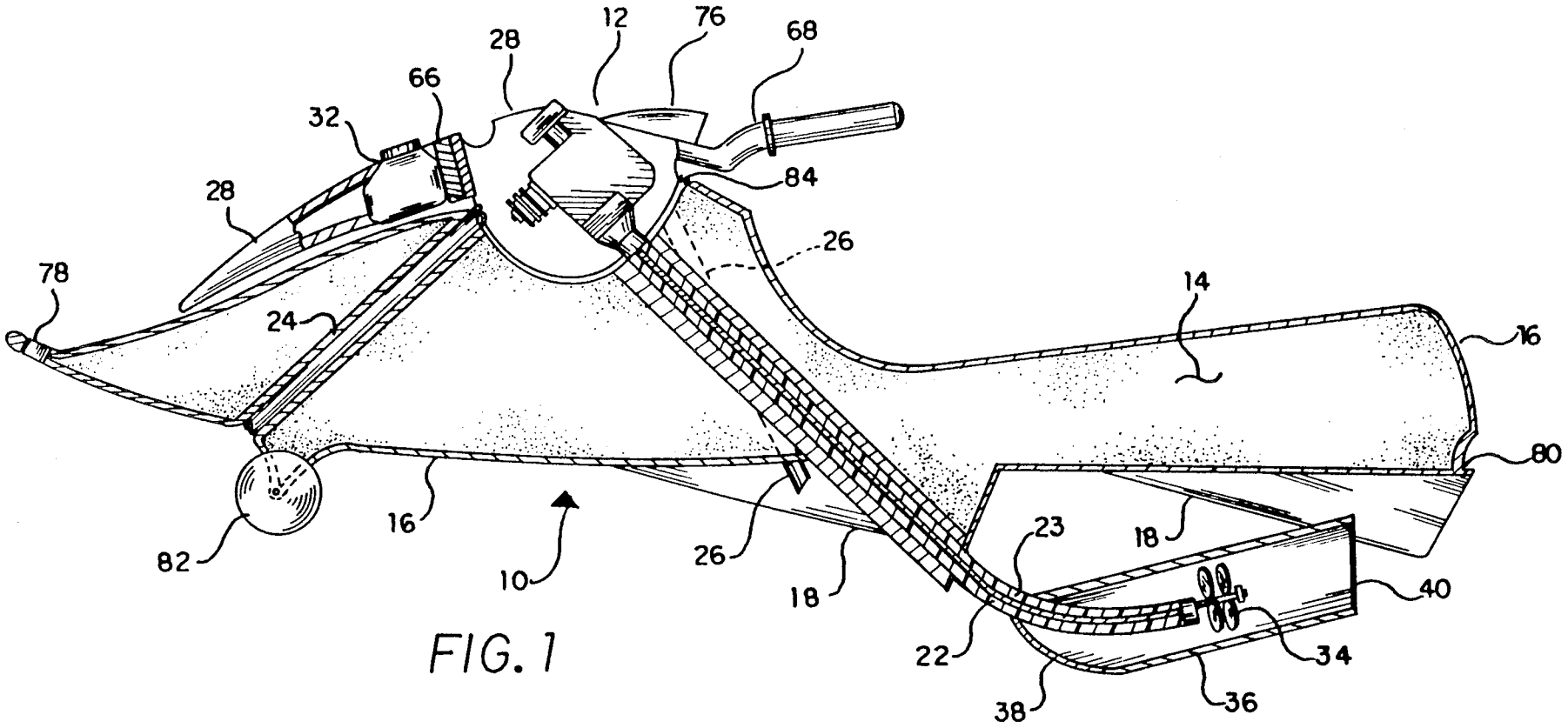
FIG. 1 is a side view, in section, of the watercraft of the present invention showing how the power system is installed.

Referring now to the drawings, particularly FIG. 1, the present invention will be seen to relate to a personal watercraft 10 which is specifically designed to incorporate a slightly modified string trimmer 12 or like apparatus as a power system. Watercraft 10 is of a general configuration similar to the type commonly known as the JET SKI. However, watercraft 10 will be seen to possess many features and qualities not known in other generally similar craft.

The hull 14 of watercraft 10 may be formed of a closed cell foam plastic material or other lightweight, buoyant material. Hull 14 may be molded or otherwise formed in the shape desired, and then covered with a durable shell 16. Preferably, shell 16 is formed of pliable vinyl plastic. However, glass fiber and resin composition or other material as desired may be used, as is well known in the art. Other construction methods may also be used at the discretion of the constructor. However, by using the construction method described above, watercraft 10 is rendered practically unsinkable. Keels 18 may also be formed separately or with the hull in order to provide greater stability when operating on the water. Such keels 18 may be reinforced along their bottom edges for greater durability, and may incorporate additional ballast in order to further aid the self righting tendencies of the watercraft 10 should a capsize occur.

While the major portion of hull 14 is preferably filled with a buoyant material, space is provided for a driveshaft tunnel 20 through which the driveshaft housing 22 of power system 12 may be installed, as well as passages for other purposes. Driveshaft tunnel 20 may be formed of a tube of polyvinyl chloride (PVC), aluminum, or other suitable material as desired. Driveshaft tunnel 20 serves not only as a passage for driveshaft housing 22, but also to stiffen the general structure of hull 14.

Typically, any string trimmer which might be modified for use as a power system 12 for such a watercraft 10 will have a driveshaft housing 22 which is curved for greater ease of use in its intended operation. Driveshaft tunnel 20 is formed so as to take advantage of this curvature, by inclining the tunnel 20 to a degree approximately equal to that of the typical amount of curvature formed in the driveshaft housing 22 of the typical string trimmer. In this way, two objectives are accomplished: The angle allows the mounting of the power head 30 well clear of the waterline, and the output or lower end of the driveshaft housing 22 is very nearly horizontal, thus providing for an efficient thrust line as well as proper balance and ergonomics.

In a similar manner, a passage 24 is provided for the intake of coolant water for the exhaust and another passage 26 for the exit of engine exhaust. Passages 24 and 26 may also be formed of a PVC material or other material as desired. It is not necessary to use a heavier material capable of withstanding high heat for exhaust passage 26 due to the provision of a method of cooling the engine exhaust prior to the exhaust entering passage 26, as will be further described below.

Power system 12 generally comprises an internal combustion engine powered string trimmer or the like, such as a WEED EATER or similar apparatus. Power system 12 is slightly modified for use as a power system for watercraft 10, such modifications consisting of only external removal and replacement of various components such as handlebars, string trimmer head and fuel tank. A streamlined fairing 28 is provided for power system 12 and other ancillary components. Fairing 28 is rigidly attached to power system 12 and pivots with power system 12 to maneuver the watercraft 10, as will be further described below.

In order to install power system 12 within watercraft 10, the power head 30 is separated from driveshaft housing 22. This is generally accomplished by loosening a collar, not shown, which is used to secure the upper or input end of driveshaft housing 22 to the power head 30 when power system 12 is to be used as a string trimmer. Any handles, not shown, which may be installed on driveshaft housing 22 when the device is used as a string trimmer are also removed at this time. Due to the curved shape of driveshaft housing 22, it cannot be inserted into driveshaft tunnel 20 from above. However, once the power head 30 has been removed, the upper or input end of driveshaft housing 22 may be inserted into driveshaft tunnel 20 from below, passed completely through the driveshaft tunnel 20 and hull 14, and power head 30 reinstalled upon the upper end of driveshaft housing 22.

Typically, such a string trimmer will be equipped with a fuel tank. However, since fairing 28 may contain a fuel tank 32, the existing fuel tank which may be installed on such a string trimmer may be removed. Alternatively, such an existing string trimmer fuel tank may be reinstalled within fairing 28 to replace fuel tank 32. The string trimmer, brush cutter or other type cutting or trimming head which may be attached to the lower or output end of a driveshaft or driveshaft cable 23 within driveshaft housing 22 is also removed, generally in a similar manner to that used in the removal of power head 30 from the upper end of drive shaft housing 22, and/or removing any threaded attachment of the string trimmer head to the driveshaft or driveshaft cable 23 contained within driveshaft housing 22.

In order to provide propulsion for watercraft 10, a propulsion means 34 is attached to the lower or output end of driveshaft or driveshaft cable 23. Propulsion means 34 preferably comprises two sets of propeller blades coaxially attached to driveshaft or driveshaft cable 23, but may also comprise a single set of blades if so desired. Alternatively, propulsion means 34 may comprise one or more impeller blade units. Propulsion means 34 is completely enclosed within shroud 36 in order to prevent injury to any persons using watercraft 10 or in its vicinity. Shroud 36 is rigidly installed on the lower or output end of driveshaft housing 22 around propulsion means 34, and contains inlet end 38 and outlet end 40. Inlet and outlet ends 38 and 40 are preferably screened or otherwise guarded in order to prevent contact with propulsion means 34 or possible fouling of propulsion means 34, e.g. by weeds or fishing lines.

Figure 2:
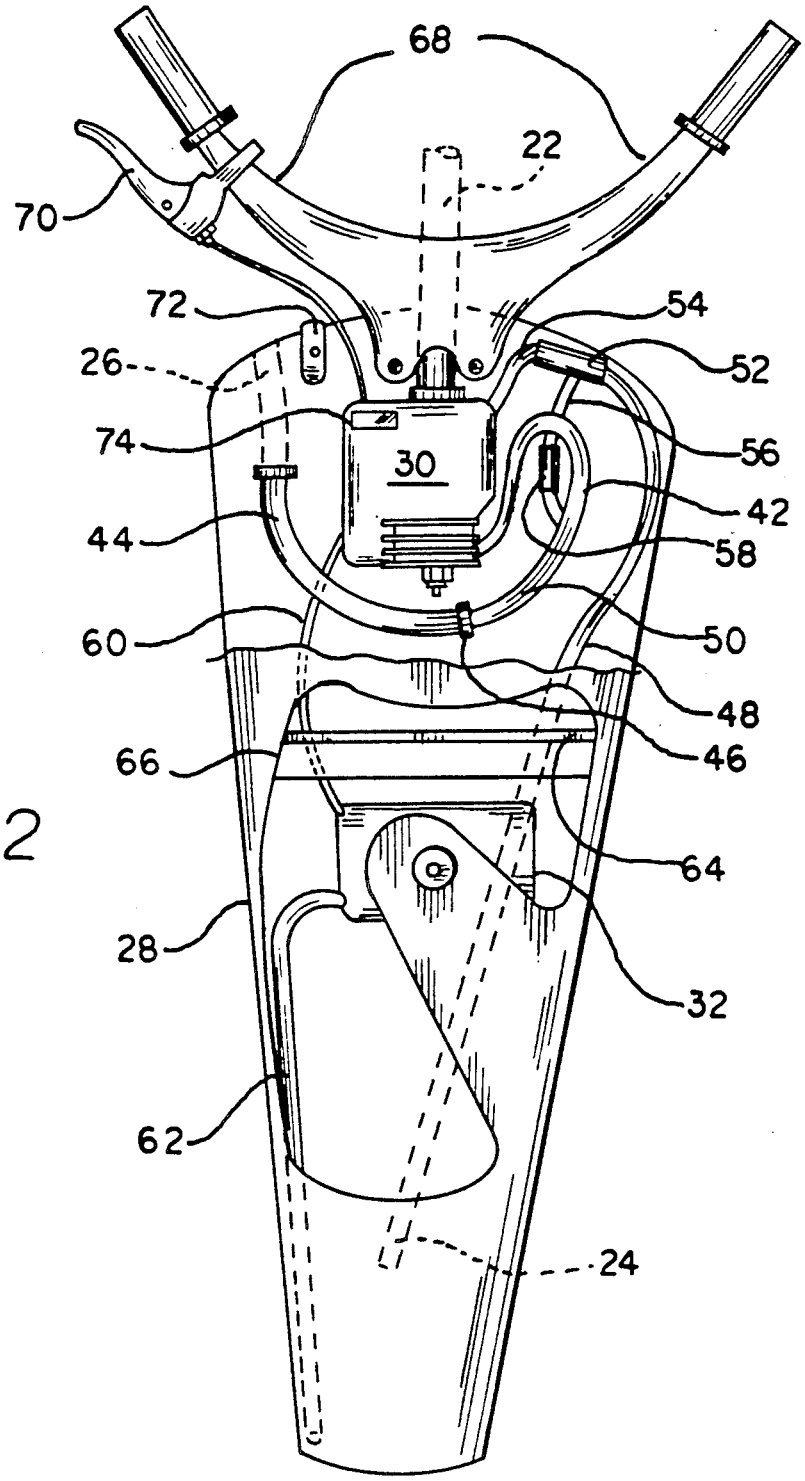
FIG. 2 is a top view, partially cut away, of the power head fairing showing the relationship of the various components and the exhaust cooling system.

FIG. 2 discloses further details relating to the fuel, cooling, and exhaust systems of power head 30. As coolant intake passage 24 and exhaust passage 26 are fixed within hull 14 of watercraft 10, and driveshaft housing 22 of power system 12 must be free to rotate within driveshaft tunnel 20 in order to provide for steering, flexible interconnections must be provided. While the standard steel exhaust pipe 42 is bolted to the exhaust port of power head 30, a tube 44 of relatively pliable and flexible material is joined to the steel exhaust pipe at 46. This system precludes the ejection of the engine exhaust upward into the face of the operator by routing all exhaust outward through the bottom of the hull 14 by means of exhaust outlet 26.

The exhaust is cooled in order to prevent the melting of the flexible material of tube 44 and/or passage 26 by means of cooling water from intake passage 24. Intake passage 24 connects to a flexible tube 48 in order to provide the required freedom of motion for power system 12. The inherent vibration absorbent properties of such flexible tubes 44 and 48 also tend to reduce operator stress (e.g., "whitefingers disease") by reducing the overall vibration level which might otherwise be transmitted to the operator through the fairing 28 and handlebars 68.

When watercraft 10 is in motion, sufficient dynamic water pressure exists at the opening of intake passage 24 to force cooling water upward through passage 24, through flexible coolant tube 48 and thence through the exhaust system 42 and 44 by means of coolant/exhaust interconnect 50. However, at relatively slow speeds there may not be sufficient dynamic water pressure at the opening of intake passage 24 to provide for the cooling of the exhaust prior to its entering flexible tube 44. In order to provide the necessary water flow, a pressure operated pump 52 of the diaphragm type or the like is provided. Pump 52 may be operated by pressure delivered from the crankcase of power head 30, as is well known in two stroke engines of the type commonly used in such string trimmers, as well as other two stroke engine applications as used in boat motors and snowmobiles, etc. A pressure line 54 supplies pump 52 with the necessary pressure to draw cooling water through intake passage 24 and flexible tube 48, and out through coolant delivery tube 56.

In order to prevent a back flow of exhaust gasses and/or coolant through coolant delivery components 24, 48, 52 and 56, a one way check valve 58 is installed in delivery tube 56 between pump 52 and exhaust pipe 42. Check valve 58 may be a positive crankcase ventilation (PCV) valve as is commonly used in automobile engines, or a similarly functioning valve. Such a valve 58 will allow cooling water to flow from intake components 24 and 48 through pump 52 and thence through coolant delivery tube 56 to exhaust pipe 42, but will close and block any tendency for flow to occur from exhaust pipe 42 back through tube 56, pump 52 and out through the remainder of the coolant intake system, thereby protecting the pump 52 and internal components thereof from exhaust heat and/or fatigue.

As noted above, fairing 28 may also contain a fuel tank 32 to supply power head 30 with fuel. Fuel line 60 extends from fuel tank 32 to the fuel inlet for the induction system for power head 30. A fuel tank vent line 62 is also provided, extending from fuel tank 32 forward and downward to the nose of fairing 28, in order to direct any fuel vapor or liquid overflow safely away from power head 30 and/or various exhaust components such as 26, 42, and 44. Fuel tank 32 is protected from engine and exhaust heat by a firewall 64 of aluminum or other suitable material and insulating material 66.

In order to complete the installation of power system 12 within watercraft 10, fairing 28 is secured to power head 30 and the various connections completed for fuel, exhaust and coolant systems as described above. Handlebars 68 are then bolted to the top of fairing 28 (or may be integrally formed with fairing 28), and any throttle control 70 which was detached from the original string trimmer assembly may be attached to handlebars 68. Other required features and attachments, such as recoil starter handle 72, ignition kill switch 74, and choke or primer, not shown, remain with power head 30 throughout the modification process and are not altered or relocated. An additional upper fairing or windshield 76 may also be installed.

Figure 3:
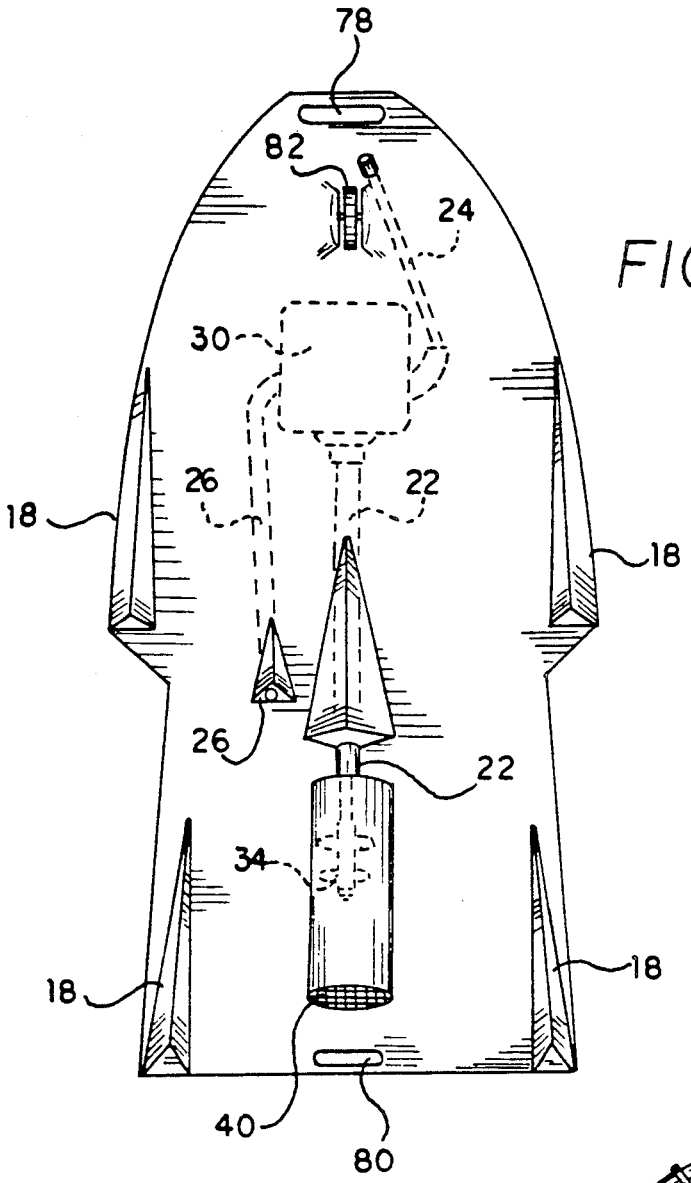
FIG. 3 is a bottom view of the watercraft, showing the location of various internal and external components.
Figure 4:
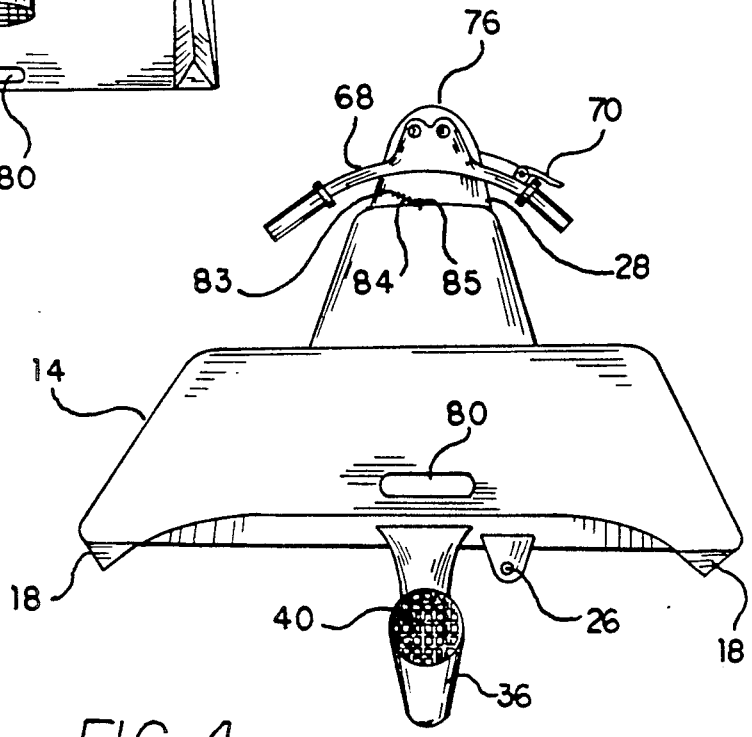
FIG. 4 is a rear view of the watercraft.

Operation of watercraft 10 is a relatively simple procedure. Watercraft 10 is a very lightweight device, typically weighing some 45 pounds depending primarily upon the exact type of power system 12 installed. Thus, watercraft 10 may be easily transported on top of or within the cargo or luggage space provided in the typical automobile, and may be removed from and installed upon or within the automobile by a single adult or two smaller juvenile operators. Additional persons other than the operator or operators are not needed in order for a person or persons to enjoy the device. Watercraft 10 is equipped with a bow hand hold 78 and a stern hand hold 80 as shown in FIG. 3, thus providing for ease of handling by one or two persons. A wheel 82 is also installed on the underside near the front of hull 14 near exhaust coolant intake 24 in order for a single person to maneuver watercraft 10 upon the shore. In this manner, watercraft 10 may be transported and maneuvered much like a wheelbarrow.

Once watercraft 10 has been assembled and fueled as required, it may be placed in the water and the engine started in a manner common to that used with typical string trimmers and the like. The operator may then open the throttle 70 and operate the watercraft 10 in a manner similar to that of similar but larger, heavier and higher performance craft.

Typically, such string trimmers as would be used as power systems 12 in such a watercraft 10 are equipped with centrifugal clutches in order to provide for greater safety when the engine is at or near idle speed. Such a centrifugal clutch, not shown, causes the output shaft within the driveshaft 22 to disengage at relatively low speeds, thus causing any device attached to the driveshaft to stop. Many such string trimmers have such clutches installed at the power head end of the driveshaft 22, thus automatically providing for the stoppage of the output shaft and therefore any string trimmer head, propeller, or other device attached to the output end of the shaft. This is of course a desirable feature in such a power system 12 which might be used in a watercraft 10, should the operator fall from the watercraft 10.

However, some string trimmers are equipped with centrifugal clutches at the output end of the driveshaft 22, and in some cases the clutch may be integral with the string cutting head which is removed for the installation of propeller or propellers 34 and shroud 36. In this case, watercraft 10 will continue to move even with the throttle control closed, as would automatically occur should the operator fall from the watercraft 10. Thus, it is very desirable that provision be made to cause watercraft 10 to circle if left on its own with no other input. Various means well known in the art may be used to accomplish such an automatic circling maneuver, such as angling one or more of the keels 18, asymmetric thrust, and/or the provision of a biasing spring 84, which tends to turn power system 12 to some angle other than straight ahead, thus causing the thrust line to be diverted to one side and watercraft 10 to turn.

In FIG. 3 of the drawings, one end of biasing spring 84 will be seen to be secured to a point 83 which is located to one side of the centerline of fairing 28, while the opposite end will be seen to be secured to a point 85 located approximately on the centerline of hull 14 and near fairing 28. Thus, when spring 84 is installed with (for example) a tensile biasing force between point 83 on fairing 28 and point 85 on hull 14, fairing 28 and associated power system 12 will be angularly displaced about the axis defined by driveshaft tunnel 20. This bias provided by spring 84 and the resulting angular displacement to power system 12 will be seen to also angularly displace propulsion means 34 and shroud 36, and thereby cause any thrust provided by propulsion means 34 to be displaced to one side of the centerline of watercraft 10 and thereby cause watercraft 10 to travel in an arcuate path rather than a straight line. Preferably, the torque provided by the operating power head 30 (in the absence of any clutch means) will cause driveshaft 22 to rotate within driveshaft tunnel 20, thereby diverting the thrust line to one side and causing watercraft 10 to turn.

Normally, an operator will open the throttle by applying pressure to the control handle 70 as noted above in order to accelerate watercraft 10 to the desired speed. Turns are normally accomplished by directing the thrust line of propulsion means 34 and shroud 36 in the direction of the desired turn, i.e., a left turn is accomplished by directing propulsion means 34 and shroud 36 to the left, thus pushing the stern of the watercraft 10 to the right and causing the bow to point to the left. The above example is accomplished by pushing the left side of the handlebar 68 somewhat laterally forward and downward so as to rotate power system 12 and driveshaft housing 22 within driveshaft tunnel 20, thereby directing the thrust of propulsion means 34 and shroud 36 in the desired direction, i.e., to the right. Conversely, pushing the right side of the handlebar forward and downward acts to accomplish a right turn. Turns may also be made to a certain extent by the operator shifting his or her weight toward the side to which it is desired to turn, thus increasing displacement and therefore drag on that side, or alternatively the operator may increase drag on a given side by extending a foot or feet into the water on that side. In the above manner, an operator may cause watercraft 10 to accelerate, turn left or right, and decelerate as desired to guide and maneuver the craft in any manner desired.

It is to be understood that the present invention is not limited to the sole embodiment described above, but encompasses any and all embodiments within the scope of the following claims.

I claim:

1. A watercraft intended for use by one or more persons, said watercraft containing a driveshaft tunnel, said driveshaft tunnel extending from an input opening on the upper surface of said watercraft and downward and rearward through said watercraft hull to an output opening on the lower surface of said watercraft hull and thereby forming an angle from the horizontal axis of said watercraft, said watercraft containing a power system, said power system generally comprising the power head, driveshaft housing and driveshaft of a shaft driven vegetation trimmer means, said driveshaft housing having an input end and an output end and having a bend near said output end, said bend having an angle approximately equal to said driveshaft tunnel angle, said driveshaft being rotatably disposed within said driveshaft housing and having an input end and an output end corresponding to said input end and said output end of said driveshaft housing, said power head located adjacent said upper surface of said watercraft and attached to said input end of said driveshaft, said power system having means installed thereupon permitting said power system to be pivoted about an axis defined by said driveshaft housing, said driveshaft housing and said driveshaft extending through and closely cooperating with said driveshaft tunnel and capable of being pivoted therein, said output end of said driveshaft having propulsion means, whereby said power system may provide both propulsion and guidance for said watercraft.

2. The watercraft of claim 1 wherein;

said means permitting pivoting of said power system comprise a fairing and handlebars, said fairing and handlebars rigidly attached to said power system.

3. The watercraft of claim 1 including;

one or more keels extending generally downward beneath said lower surface of said watercraft.

4. The watercraft of claim 1 including;

hand holds located at the forward end and rearward end of said watercraft.

5. The watercraft of claim 1 including;

a wheel located beneath said lower surface of said watercraft and near said forward end of said watercraft.

6. The watercraft of claim 1 including;

means pivotally biasing said power system, thereby urging said watercraft to deviate from a straight path.

7. The watercraft of claim 6 wherein;

said pivotally biasing means is a spring.

8. The watercraft of claim 1 including;

a generally cylindrical shroud having an inlet end and an outlet end, and said shroud located near said output end of said driveshaft and enclosing said propulsion means.

9. The watercraft of claim 8 wherein;

said shroud includes guard means at said inlet and said outlet ends.

10. The watercraft of claim 1 including;

an exhaust system for said power system, a coolant intake system for said exhaust system, said exhaust system and said coolant intake system passing at least partially through said hull of said watercraft, said exhaust system and said coolant intake system at least partially formed of flexible and resilient tubes and thus allowing movement between said power system and said watercraft, said coolant intake system joining with said exhaust system, whereby said coolant intake system may provide cooling means for said flexible and resilient tubes of said exhaust system.

11. The watercraft of claim 10 wherein;

said coolant intake system includes pump means providing positive flow through said coolant intake system to said exhaust system.

12. The watercraft of claim 10 wherein;

said coolant intake system includes a check valve located between said pump means and said exhaust system, whereby said check valve may prevent flow from said exhaust system to said pump means.

13. The watercraft of claim 11 wherein;

said pump means is powered by pressure provided by crankcase pressure of said power system.

14. A method of modifying a shaft driven vegetation trimmer means for use as a power system for a watercraft having a hull with a cooperating driveshaft tunnel passing completely therethrough, the method comprising the following steps:

removing any string trimmer head or similar device from the output end of the string trimmer driveshaft, removing any handles from said driveshaft, removing any throttle control means from said handles, removing the power head from the input end of said driveshaft, installing said driveshaft within said driveshaft tunnel of said watercraft by inserting said input end of said driveshaft into the lower end of said driveshaft tunnel and passing said driveshaft completely through said driveshaft tunnel, installing said power head upon said input end of said driveshaft, installing propulsion means upon said output end of said driveshaft, and installing means providing rotation to said power system upon said power head.

* * * * *